US005335286A

United States Patent [19]

Carlson et al.

[11] Patent Number: 5,335,286

[45] Date of Patent: Aug. 2, 1994

[54] ELECTRET ASSEMBLY

[75] Inventors: Elmer V. Carlson, Prospect Heights; William J. Ballad, Buffalo Grove, both of Ill.

[73] Assignee: Knowles Electronics, Inc., Itasca, Ill.

[21] Appl. No.: 836,606

[22] Filed: Feb. 18, 1992

[51] Int. Cl.[5] ..... H04R 25/00

[52] U.S. Cl. ..... 381/191; 381/174; 381/193

[58] Field of Search ..... 381/191, 174, 173, 116, 381/113, 188, 193, 203, 196

[56] References Cited

U.S. PATENT DOCUMENTS

| | | | |
|---|---|---|---|
| Re. 28,420 | 5/1975 | Murphy . | |
| Re. 33,718 | 10/1991 | Carlson et al. | 381/191 |
| 3,740,496 | 6/1973 | Carlson et al. . | |
| 3,778,561 | 12/1973 | Reedyk | 381/191 |
| 3,941,946 | 3/1976 | Kawakami et al. . | |
| 3,946,422 | 3/1976 | Yagi et al. . | |
| 4,117,275 | 9/1978 | Miyanaga et al. . | |
| 4,246,449 | 1/1981 | Biber . | |
| 4,263,484 | 4/1981 | Hisatsune et al. . | |
| 4,331,840 | 5/1982 | Murphy et al. | 381/191 |
| 4,418,246 | 11/1983 | Sawyer . | |
| 4,419,545 | 12/1983 | Kuindersma | 381/191 |
| 4,558,184 | 12/1985 | Busch-Vishniac et al. | 29/594 |
| 4,621,171 | 11/1986 | Wada et al. | 381/191 |
| 4,730,283 | 3/1988 | Carlson et al. | 381/191 |
| 4,891,843 | 1/1990 | Paulus, Jr. et al. | 381/191 |
| 5,097,515 | 3/1992 | Baba | 381/191 |

FOREIGN PATENT DOCUMENTS

| | | | |
|---|---|---|---|
| 0036071 | 11/1970 | Japan | 381/173 |
| 0161317 | 12/1979 | Japan | 381/191 |
| 0014299 | 1/1982 | Japan | 381/191 |
| 0048600 | 3/1983 | Japan | 381/191 |
| 0092199 | 6/1983 | Japan | 381/191 |
| 0205399 | 11/1983 | Japan | 381/191 |
| 0207797 | 12/1983 | Japan | 381/191 |
| 0207798 | 12/1983 | Japan | 381/174 |
| 0209299 | 12/1983 | Japan | 381/191 |
| 0571778 | 9/1945 | United Kingdom | 381/174 |

*Primary Examiner*—Curtis Kuntz
*Assistant Examiner*—Huyen D. Le
*Attorney, Agent, or Firm*—Dorn, McEachran, Jambor & Keating

[57] ABSTRACT

A tiny electret assembly for an electroacoustic hearing aid transducer, either a microphone or a sound reproducer, includes a thin, flexible, planar diaphragm and a planar backplate, the diaphragm and the backplate constituting the electret electrodes. One of the two electrodes is permanently charged to a given differential voltage relative to the other and the two electrodes are mounted, in the transducer, in fixed, spaced, substantially parallel relation to each other; the differential voltage between the electrodes pulls a central portion of the diaphragm toward the backplate, tensioning and stiffening the diaphragm. The mount for the diaphragm permits movement of the diaphragm rim in the plane of the diaphragm but precludes movement of the rim of the diaphragm perpendicular to the plane of the diaphragm (and the backplate) so that the diaphragm cannot buckle. Different rim mounts for the diaphragm are described.

11 Claims, 2 Drawing Sheets

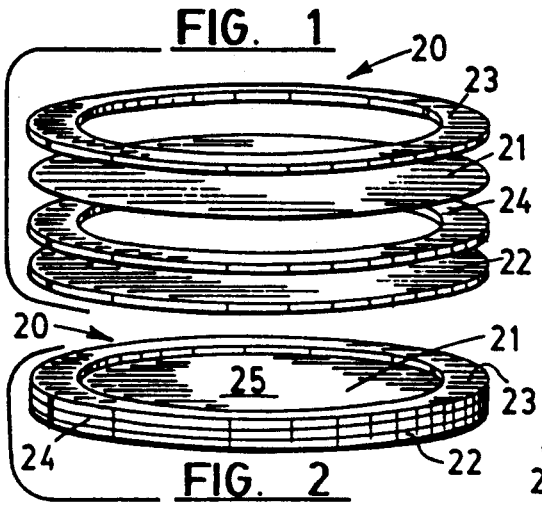
FIG. 1
FIG. 2
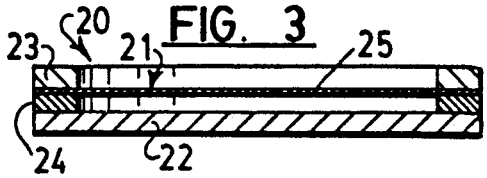
FIG. 3
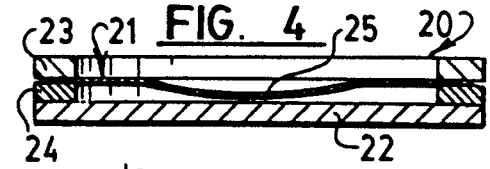
FIG. 4
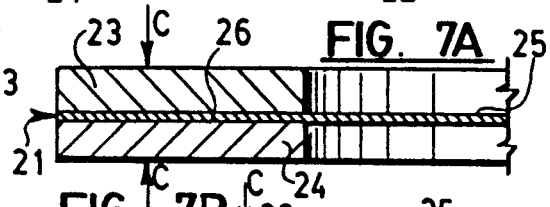
FIG. 7A
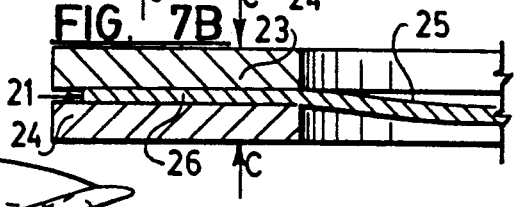
FIG. 7B
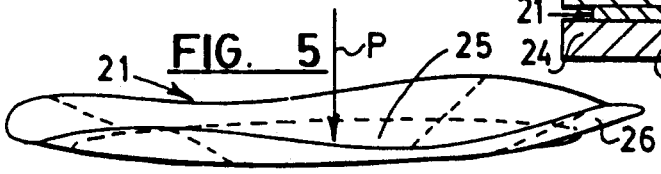
FIG. 5
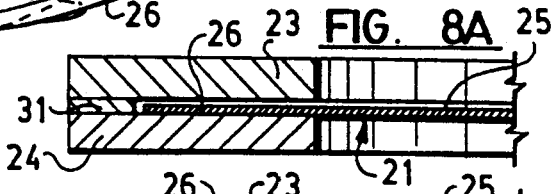
FIG. 8A
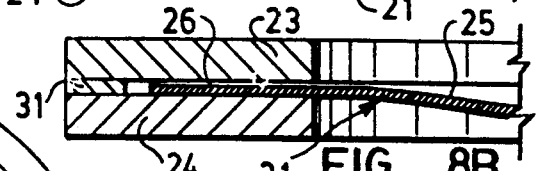
FIG. 8B
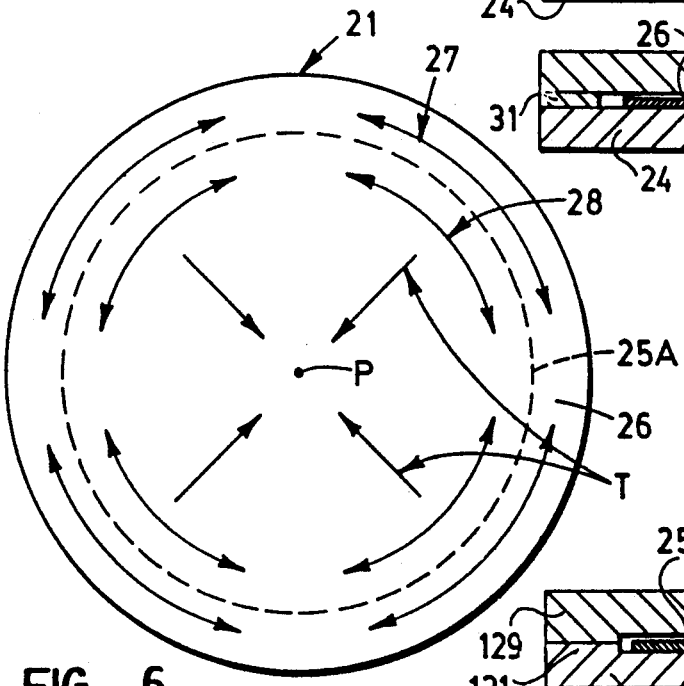
FIG. 6
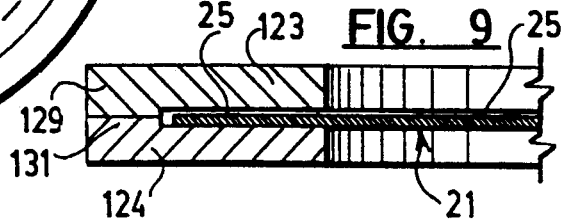
FIG. 9

ELECTRET ASSEMBLY

BACKGROUND OF THE INVENTION

The diaphragm of an electret used in a microphone vibrates in response to an acoustic wave signal impinging upon the diaphragm; that vibration varies the spacing between the diaphragm and a backplate. The diaphragm and backplate comprise the electrodes of the electret. One of the electrodes is electrostatically charged to establish a voltage differential between them. The resulting variation in capacitance between the electrodes created by movements of the diaphragm enables the electret to generate an electrical signal representative of the impinging acoustic signal. In a sound reproducer, the process works in reverse. An electrical signal applied across the diaphragm and backplate electrodes of the electret vibrates the diaphragm to generate an acoustic signal.

Electret transducers can be made quite tiny in size, and hence have frequently found use in hearing aids, particularly in-the-ear hearing aids. The maximum dimension of an electret transducer for a hearing aid, particularly a microphone, may be of the order of 0.125 inch. Indeed, a hearing aid may incorporate two electret transducers; a electret microphone is used to convert acoustic signals to electrical signals, which are then amplified and applied to an electret sound reproducer (often called a "receiver") for reconversion to an acoustic signal fed into the user's ear canal.

But a hearing aid presents a decidedly adverse environment for an electroacoustic transducer of any kind. Temperature and moisture conditions vary materially. Aging affects virtually any transducer; in an electret, in particular, the voltage differential between the diaphragm and backplate electrodes may be stable for a year or more, but may then fall off, over a period of time, to a lower level. The mechanical properties of parts of the electret, especially the mechanical dimensions of the diaphragm, may change with time.

It has been customary to pre-stress the diaphragm of an electret mechanically because appreciable stiffness is desirable for effective operation in either a microphone or an acoustic reproducer. If the diaphragm is too compliant, it may collapse against the other electrode. In most electret assemblies, conventional wisdom has required firm anchoring of the rim or periphery of the diaphragm, so that a tensioned condition can be maintained. A few prior constructions have utilized specialized diaphragm constructions that do not require prestressing of the diaphragm, as in Carlson et al. U.S. Pat. Nos. 3,740,496 an Sawyer 4,418,246. But those specialized diaphragm constructions have usually employed corrugations or "bumps" of one form or another, either at the rim or in the central portion of the diaphragm.

SUMMARY OF THE INVENTION

In an electret the electrostatic charge (voltage) differential between the diaphragm and the backplate tends to pull the diaphragm toward the backplate. The resulting quite minor deformation of the diaphragm tends to stiffen it, an effect that may be utilized to minimize or even eliminate any need for mechanical tensioning of the diaphragm. But further increase in the voltage differential may cause the diaphragm to buckle and ripple or even collapse, in a manner essentially fatal to transducer performance.

A principal object of the present invention, therefore, is to provide a new and improved electret assembly for an electroacoustic transducer, particularly of a tiny size suitable for hearing aid use, that utilizes a voltage differential between the electret electrodes to tension the diaphragm electrode, yet precludes possible buckling and rippling of the diaphragm.

Another object of the invention is to provide a new and improved electret assembly construction that compensates at least in part for the effects of temperature and humidity variations and aging, yet is relatively simple and economical to manufacture and assemble.

Accordingly, the invention relates to an electret assembly for an electroacoustic transducer, the assembly comprising a thin, flexible, planar diaphragm comprising the first electrode of an electret assembly, and a planar backplate comprising a second electrode for the electret assembly, with one electrode charged to a given differential voltage relative to the other electrode. The assembly further comprises diaphragm mounting means for mounting the diaphragm in fixed, spaced, substantially parallel relation to the backplate, with the differential voltage tending to pull a central portion of the diaphragm toward the backplate, thereby tensioning and stiffening the central portion of the diaphragm. The diaphragm mounting means permits limited radial movement of the rim of the diaphragm in the plane of the diaphragm but precludes movement of that rim perpendicular to the plane of the diaphragm.

BRIEF DESCRIPTION OF THE DRAWINGS:

FIG. 1 is an exploded perspective view of the components of an electret assembly for an electroacoustic transducer in according to one embodiment of the invention;

FIG. 2 is a perspective view of an electret assembly utilizing the components of FIG. 1;

FIG. 3 is an idealized sectional view of the assembly of FIG. 2;

FIG. 4 is a sectional view like FIG. 3 but more nearly representative of operating conditions in the electret assembly;

FIGS. 5 and 6 are simplified views of the electret diaphragm used to explain conditions occurring in the assembly of FIGS. 1–4;

FIGS. 7A and 7B are detail views, on an enlarged scale, illustrative of one construction of the diaphragm mount for the electret assembly of FIGS. 1–4;

FIGS. 8A and 8B are detail views, like FIGS. 7 and 7B, of another embodiment of the diaphragm mount;

FIG. 9 is a detail view, like FIG. 7, of a further embodiment of the diaphragm mount;

DESCRIPTION OF THE PREFERRED EMBODIMENTS

Figure 10:
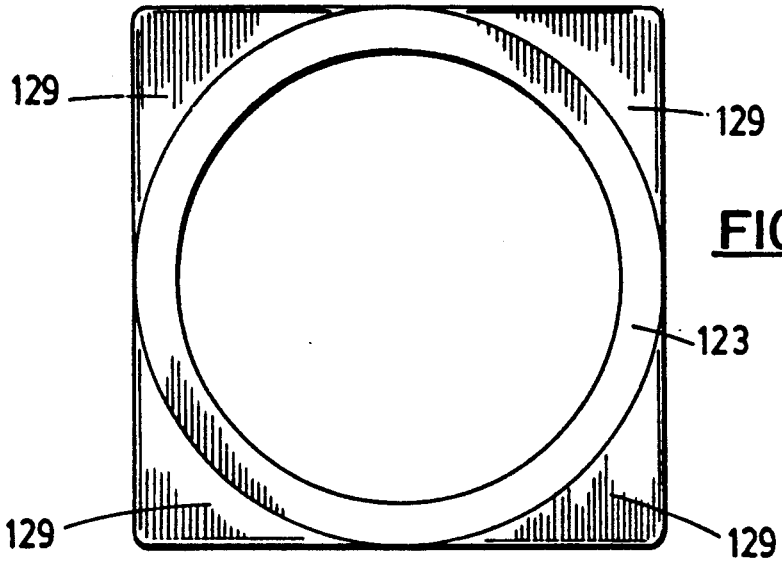
FIG. 10 is a plan view, on a reduced scale, of one of the mounting members of FIG. 9.

FIG. 1 illustrates basic components for an electret assembly 20 constructed in accordance with the present invention. Electret assembly 20 includes a thin, flexible, planar diaphragm 21. Diaphragm 21, in the illustrated preferred construction, is of circular configuration, but a diaphragm of rectangular shape or other configuration could be employed. The diaphragm may comprise a thin, flexible sheet of metal or other conductive material. The diaphragm is more frequently constructed as a composite film of a tough, strong, resin such as polyethylene terephthlate, commonly available under the trade name MYLAR and under other trade names, with a thin conductive film vacuum-/or vapor-deposited upon one or upon both surfaces of the resin film. Diaphragm 21 may be permanently electrostatically charged, in which case it may function as the charged electrode of the electret; usually, it is not so charged.

The other electrode for electret assembly 20 is a backplate 22, again shown in FIG. 1 as being of circular configuration. If diaphragm 21 is the charged electrode, then backplate 22 may be simply a metal plate. Frequently, however, backplate 22 is covered with a thin insulating layer or coating on the surface of the backplate that faces toward diaphragm 21. With such a coating, backplate 22 may be the electrostatically charged electrode of the electret assembly 20, and frequently is. A variety of resins such as fluorocarbon resins, commonly available under the trade name TEFLON, are capable of maintaining an electrostatic charge for a long period of time may be utilized in those instances in which the backplate 22 is to constitute the charged electrode of the electret.

There are two additional components, mounting members 23 and 24, in electret assembly 20. The outer diameter of each of these mounting members 23 and 24, in the illustrated construction, is matched to the outer diameter of diaphragm 21. This is not an essential condition to operation of the electret; if preferred, mounting rings 23 and 24 could be made to have larger or smaller outer diameters than the other elements of the assembly. The inner diameters of the rings 23 and 24 are preferably the same; they define the outer limit of a central portion 25 of diaphragm 21. In the assembled form of electret 20, the components are stacked from bottom to top in the sequence backplate 22, mounting member 24, diaphragm 21, and mounting member 23, as shown in each of FIGS. 1–4.

As thus far described, there is nothing remarkable or novel about electret assembly 20. It functions in the usual manner of an electret. Thus, in a microphone an acoustic signal impinging upon the central portion 25 of diaphragm 21 causes the diaphragm to vibrate or move in a direction perpendicular to the plane of the diaphragm. Each such movement of the diaphragm changes the capacitance between the two electrodes of the electret, diaphragm 21 and backplate 22. An electrical circuit (not shown) connected to these two electrodes generates an electrical signal that is representative of the impinging acoustic signal.

Electret 20 also can function in the reverse manner, converting an electrical signal into an acoustic signal. Thus, an electrical circuit can be connected to the electrodes comprising diaphragm 21 and backplate 22; again, the external circuit is not shown. A varying electrical signal supplied to the electrodes through this circuit causes diaphragm 21 to vibrate back and forth and generates an acoustic signal. Thus, electret 20 can function as a sound reproducer or speaker. A common use for an electret of this general type is in an in-the-ear hearing aid, which may comprise an electret microphone connected by amplifier circuits to an electret sound reproducer or "receiver".

A flat sheet, or a flat disk, such as electret diaphragm 21, can be mounted to span a round opening, as shown in FIG. 2. Furthermore, it may be held and stiffened by electrostatic attraction to a backplate based upon a voltage differential, usually a permanent electrostatic charge, between the diaphragm and the backplate. This general condition is shown in FIG. 5; there, the central portion 25 of diaphragm 21 has been indicated to be attracted toward backplate 22. The deflection of the diaphragm is dependent upon the electrostatic charge differential between the electrodes 21 and 22 of the electret. However, when the voltage is increased, whether that increase is represented by a steady-state voltage differential or by a signal applied to the electrodes of the electret, the peripheral portion or rim 26 of diaphragm 21, outside of the central opening tends to buckle. As a consequence, ripples are formed in the diaphragm, as generally illustrated in FIG. 5. The ripples in the diaphragm allow air to pass around its rim. This is fatal to the performance of the electret as either a microphone or as a sound reproducer. Moreover, a further increase in the charged differential between the electrodes, diaphragm 21 and backplate 22, eventually leads to a collapse of the diaphragm into contact with the backplate. Under these conditions, electret 20 no longer functions.

The electret construction 20 is intended to utilize the stiffening phenomenon afforded by the electrostatic charge differential between electret electrodes 21 and 22 by limiting movement of the peripheral portion of diaphragm 21 in a direction perpendicular to the plane of the diaphragm while permitting some movement of the diaphragm parallel to its plane. In electret 20, this is achieved by an external structure, not shown, that applies a clamping force sufficient to prevent buckling around the rim of diaphragm 21, thereby resisting movement perpendicular to the diaphragm plane, without precluding minor radial movement. In that way, there can be no buckling of the rim portion 26 of diaphragm 21, even though some movement in the plane of the diaphragm is permitted.

Referring to FIG. 6, which shows diaphragm 21 and indicates the outer limits of the central portion 25 by dash line 25A, when the charge on the electret electrodes begins to draw the center of the diaphragm toward point P, as indicated by arrows T, the diaphragm attempts to get the extra material it needs (compare FIGS. 3 and 4) by pulling in material from the outer or rim portion 26. Movement toward the center P of this outer material is constrained because any circumferential fiber 27 is too large for the new circumference 28 that it would be required to assume if moved toward the center of the diaphragm. Thus, the rim portion 26 of the diaphragm is forced into compression which resists the migration of diaphragm material toward its center. The center portion 25 of diaphragm 21, on the other hand, is mostly in tension. The force vectors involved are essentially normal to each other and can coexist in diaphragm 21, changing in relative magnitude along each radius of the diaphragm. If the compression exceeds a critical value near the outer edge of the diaphragm, the rim of the diaphragm will buckle unless prevented from doing so. But the overall construction of electret assembly 20, by constraining and precluding any motion of the diaphragm perpendicular to its surface outside of the support opening 25A, makes it possible to achieve substantially higher compressions before the central portion 25 of the diaphragm can reach the buckling level. In this manner higher internal tensions in the center portion 25 of diaphragm 21 can be obtained while maintaining effective transducer operation. By restraining diaphragm 21 around its rim 26, with respect to movement normal to the plane of the diaphragm, while permitting movement parallel to the diaphragm plane, expansion or contraction due to environmental factors is not inhibited.

FIG. 7A illustrates, on an enlarged scale, diaphragm 21 and the two clamp members 23 and 24 that engage the rim portion 26 of the diaphragm. When these elements are installed in an electret assembly that includes a charged backplate the condition shown in FIG. 7B obtains. Diaphragm 25 is pulled toward the backplate, in this instance assumed to be below the diaphragm. The outer edge of rim portion 26 of the diaphragm may move laterally in a position parallel to the plane of the diaphragm; compare FIGS. 7A and 7B. This makes it possible for the center portion 25 of the diaphragm to stiffen in a configuration that approximates a shallow segment of a sphere. To achieve this result, light clamping pressure should be applied between members 23 and 24 as indicated by arrows C in FIGS. 7A and 7B. The pressure should be sufficient to keep the rim portion 26 of diaphragm from buckling without preventing the very limited movement of the diaphragm parallel to its plane as discussed above.

FIGS. 8A and 8B illustrate another construction that can be used for the clamp rings and diaphragm portion of the electret as previously described. Diaphragm 21 remains unchanged and clamp members 24 and 23, as shown, may be the same as in the previously described construction. In this instance, however, a thin outer ring 31 is interposed between the main clamp rings 23 and 24. Ring 31 is slightly thicker than diaphragm 21; for example, if diaphragm 21 has a thickness of approximately 0.00006 inch, then ring 31 may have a total thickness of approximately 0.00008 inch. This leaves a slight clearance for the rim 26 of diaphragm 21 between the mounting members 23 and 24. With this construction, the diaphragm is again precluded from any appreciable movement in a direction perpendicular to its plane while limited movement in a direction parallel to the diaphragm plane is permitted. This condition is illustrated by FIGS. 8A and 8B; in FIG. 8A it is assumed that there is no electrostatic field tending to pull the center portion 25 of diaphragm out of its planar configuration, whereas FIG. 8B shows the limited deflection, to the configuration of a segment of a sphere, that is produced when this portion of the device is incorporated in a complete electret.

Figure 11:
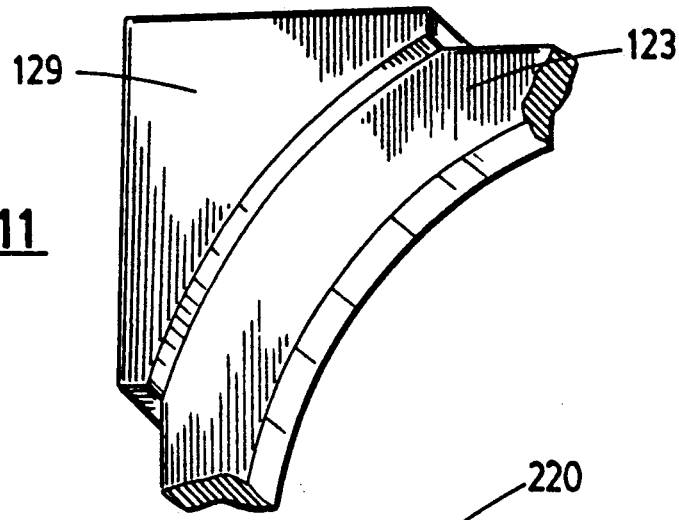
FIG. 11 is a detail perspective of one corner of the mounting member of FIG. 10.

FIGS. 9–11 illustrate a further construction that may be utilized to achieve the desired effect with respect to diaphragm 21. In this instance, each corner 129 of the two outer clamp members or rings 123 and 124 is plated to afford a thin corner projection 129 on clamp member 123 and a similar projection 131 on clamp member 124. The configuration for clamp member 123 is shown in greater detail in FIGS. 10 and 11. Typically, the spacer or pad 129 at the corner of the clamp member 123 may have a thickness of the order of 0.00004 inch. A metal layer, such as a gold layer, of this thickness can be deposited to afford the desired spacer or pad. Accordingly, the two pads 129 and 131 add up to the desired total thickness of 0.00008 inch, as contrasted to the assumed thickness 0.00006 inch for diaphragm 21. Thus, the construction shown in FIGS. 9–11 affords the same operation as the previously described constructions, limiting movement of diaphragm 21 to a direction essentially parallel to the plane of the diaphragm and precluding movement of the diaphragm 25 in a direction perpendicular to that plane so that buckling is avoided. The effect of pads 129 and 131 may also be realized by stamping or embossing mounting members 123 and 124.

Figure 12:
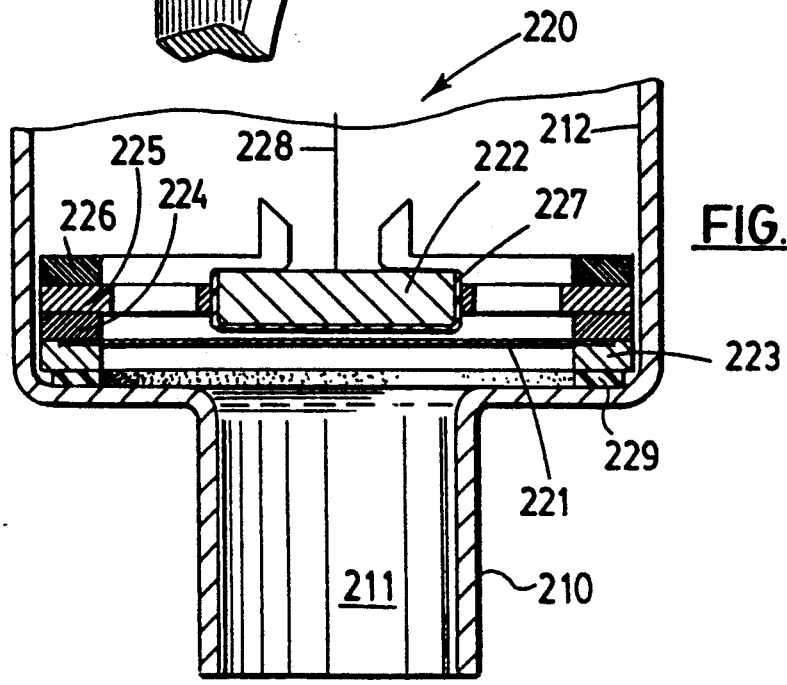
FIG. 12 is a detail sectional view of a part of a microphone constructed with an electret assembly constructed in accordance with the invention.

FIG. 12 illustrates a portion of a microphone 220 which incorporates an electret constructed in accordance with the present invention. Microphone 220 includes an external shell or housing 210, usually formed of metal, having a sound port 211. In a microphone, as shown, this would be a sound entrance. In a receiver or "speaker" it would be an acoustic output port. Housing 210 further comprises a somewhat enlarged portion 211 defining an acoustic chamber within the microphone.

The electret construction in microphone 220 conforms generally to that described above. It comprises a diaphragm 221 mounted between two support members 223 and 224 and facing a backplate 222. In the illustrated construction backplate 222 carries an external coating or film 227 of dielectric material that is electrostatically charged. That is, the backplate is the charged member of the electret in this instance. Backplate 222, with its coating 227, is mounted in an insulator support member 225 and is electrically connected to a conductor 228 that forms a part of the operating circuit for the microphone. A clamp ring 226 and an elastomer spacer 229 complete the internal construction for microphone 220 as illustrated in FIG. 12. Clamp ring 226 is utilized to maintain the other elements of the microphone in position, as shown, so that diaphragm 21 is restrained with respect to vertical movement, as shown in the drawing. However, the opening in which diaphragm 221 is mounted between members 223 and 224, utilizing a construction generally similar to that shown in FIGS. 8A and 8B, permits movement of the diaphragm in a direction parallel to its plane.

Operation of the electret portion of microphone 220, as illustrated in FIG. 12, corresponds essentially to that described above with respect to FIGS. 1–4, particularly as modified in the manner illustrated in FIGS. 8A and 8B or, indeed, in FIGS. 9–11. Accordingly, further description of the operational characteristics of the microphone is deemed unnecessary.

In the electret construction of the present invention, the electrostatic charge (voltage differential) between the diaphragm and the backplate is employed to tension the diaphragm; no additional tensioning is usually necessary. In all instances the electret incorporates mounting means, such as the mounting members 23, 24 and 123, 124 and 223, 224 permitting radial movement of the rim of the diaphragm in its plane. At the same time, however, the mounting members restrain or preclude movement of the diaphragm in a direction perpendicular to the diaphragm plane so that buckling and rippling are effectively prevented. The configuration of the members of the electret is not critical; they can be round as shown in FIGS. 1–6 or they may be rectangular as illustrated in FIG. 10. Other shapes, such as hexagons or the like, can be used if desired for facilitation of assembly or other purposes. In any event, the improved electret assembly construction of the invention compensates at least in part for the effects of temperature and humidity variations and also for changes due to aging.

We claim:

1. An electret assembly for an electroacoustic transducer comprising:

a thin, flexible, planar diaphragm comprising a first electrode of an electret assembly;

a planar backplate comprising a second electrode of the electret assembly;

one of the first and second electrodes of the assembly being charged to a given differential voltage relative to the other electrode;

and diaphragm mounting means for mounting the diaphragm in fixed, spaced, substantially parallel relation to the backplate, the differential voltage tending to pull a central portion of the diaphragm toward the backplate, thereby tensioning and stiffening the central portion of the diaphragm;

the diaphragm mounting means permitting limited radial movement of the rim of the diaphragm in the plane of the diaphragm but precluding movement of the rim of the diaphragm perpendicular to the plane of the diaphragm.

2. An electret assembly for a transducer, according to claim 1, in which one electret electrode comprises a layer of dielectric material permanently charged to afford the differential voltage relative to the other electrode.

3. An electret assembly for a transducer, according to claim 1, in which the mounting means includes first and second mounting members engaging opposite sides of the diaphragm.

4. An electret assembly for a transducer, according to claim 3, in which the mounting members have matched central openings defining a central portion of the diaphragm maintained under tension by the voltage differential between the diaphragm and the backplate.

5. An electret assembly for a transducer, according to claim 3, in which the diaphragm mounting means includes clamp means, engaging the mounting members, for maintaining a light clamping force on the mounting members, sufficient to restrain the diaphragm rim against movement perpendicular to the diaphragm plane while not preventing movement parallel to that plane.

6. An electret assembly for a transducer, according to claim 3, including spacing means, located between the mounting members maintaining a mounting space between the mounting members, around the periphery of the diaphragm, that is very slightly larger than the thickness of the diaphragm rim.

7. An electret assembly for a transducer, according to claim 6, in which the spacing means is an independent spacing member.

8. An electret assembly for a transducer, according to claim 6, in which the spacing means is an integral part of at least one mounting member.

9. An electret assembly for a transducer, according to claim 6, in which the spacing means is an integral part of mounting members on both sides of the diaphragm.

10. An electret assembly for a transducer, according to claim 1, in which one of the electrodes is materially smaller than the other.

11. An electret assembly for a transducer, according to claim 10, in which the backplate is the smaller electrode, and in which the backplate comprises a dielectric layer, facing the diaphragm, that is permanently charged to provide the differential voltage between electrodes.

* * * * *